US007967391B1

(12) United States Patent
Dalley

(10) Patent No.: US 7,967,391 B1
(45) Date of Patent: Jun. 28, 2011

(54) SAW AND WATER COMBINATION SYSTEM

(76) Inventor: Brandon J. Dalley, Wickenburg, AZ (US)

( * ) Notice: Subject to any disclaimer, the term of this patent is extended or adjusted under 35 U.S.C. 154(b) by 322 days.

(21) Appl. No.: 12/186,312

(22) Filed: Aug. 5, 2008

(51) Int. Cl.
*B28D 1/04* (2006.01)

(52) U.S. Cl. ..... 299/39.3; 299/81.1

(58) Field of Classification Search ..... 299/39.3, 299/81.1, 81.2; 239/332, 333, 289
See application file for complete search history.

(56) References Cited

U.S. PATENT DOCUMENTS

| | | | | | |
|---|---|---|---|---|---|
| 3,896,783 | A | | 7/1975 | Manning | |
| 4,779,603 | A | * | 10/1988 | Crocetti | 125/13.01 |
| 4,782,591 | A | | 11/1988 | DeVito et al. | |
| 4,876,797 | A | * | 10/1989 | Zapata | 30/388 |
| 5,826,478 | A | | 10/1998 | Zerrer | |
| 6,409,097 | B1 | * | 6/2002 | McCauley | 239/289 |
| 6,450,869 | B1 | * | 9/2002 | Sherez | 451/449 |
| 6,837,447 | B1 | * | 1/2005 | Clark | 239/318 |
| 6,916,236 | B2 | | 7/2005 | Terpstra | |
| D533,757 | S | | 12/2006 | Arvidsson et al. | |
| 2003/0188893 | A1 | * | 10/2003 | DeBlasio | 175/67 |

* cited by examiner

*Primary Examiner* — John Kreck

(57) ABSTRACT

A saw and water dispensing combination system includes a handsaw that includes a motor, a handle attached to the motor, and a blade mechanically coupled to the motor that is rotated when the motor is turned on. The blade is configured to cut through cement blocks. A shroud extends over an upper portion of the blade relative to the motor and a grip is attached to the motor distal to the blade. A container is provided that has water therein. A pump is fluidly coupled to the container and creates pressure within the container when the pump is actuated. An outlet conduit is fluidly coupled to the container. Water is forced into the outlet conduit when the pump is actuated and the outlet conduit ejects the water onto the saw blade. A coupler releasably couples the container to the handsaw.

8 Claims, 6 Drawing Sheets

SAW AND WATER COMBINATION SYSTEM

BACKGROUND OF THE INVENTION

Field of the Invention

The present invention relates to dust reducing devices and more particularly pertains to a new dust reducing device for preventing dust from being generated during the cutting of concrete block when the concrete block is being cut by a hand tool.

SUMMARY OF THE INVENTION

The present invention meets the needs presented above by generally comprising a handsaw that includes a motor, a handle attached to the motor, and a blade mechanically coupled to the motor that is rotated when the motor is turned on. The blade is configured to cut through cement blocks. A shroud extends over an upper portion of the blade relative to the motor and a grip is attached to the motor distal to the blade. A container is provided that has water therein. A pump is fluidly coupled to the container and creates pressure within the container when the pump is actuated. An outlet conduit is fluidly coupled to the container. Water is forced into the outlet conduit when the pump is actuated and the outlet conduit ejects the water onto the saw blade. A coupler releasably couples the container to the handsaw.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
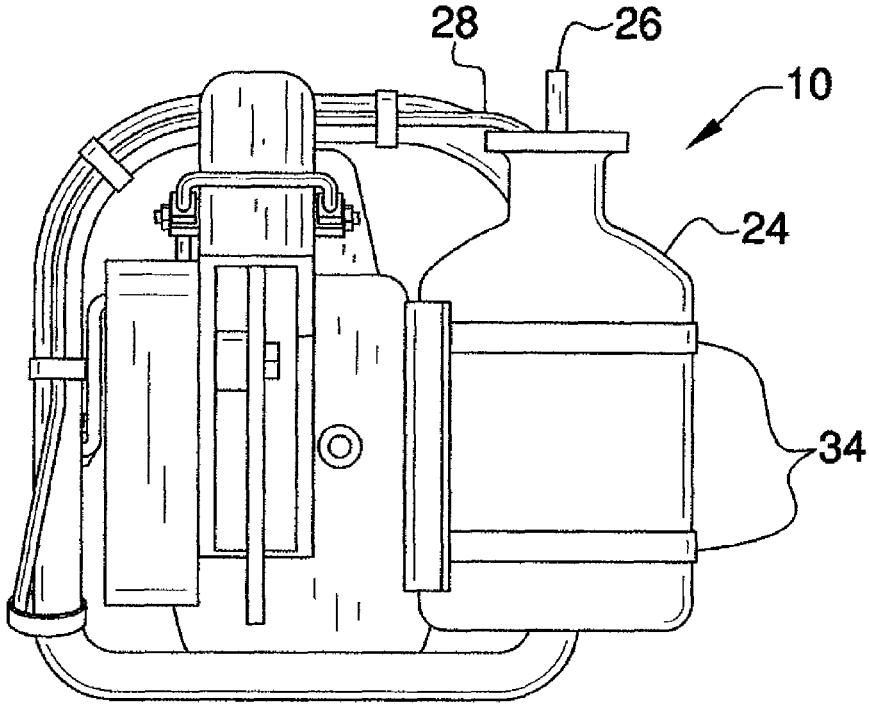
FIG. 1 is a front view of a saw and water dispensing combination system according to the present invention.
Figure 2:
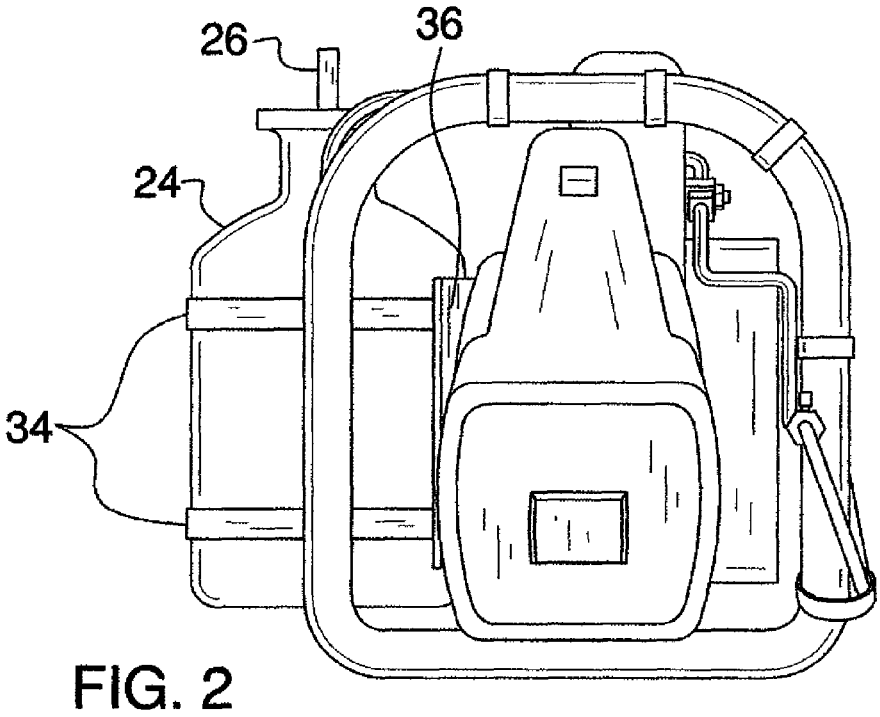
FIG. 2 is a rear view of the present invention.
Figure 3:
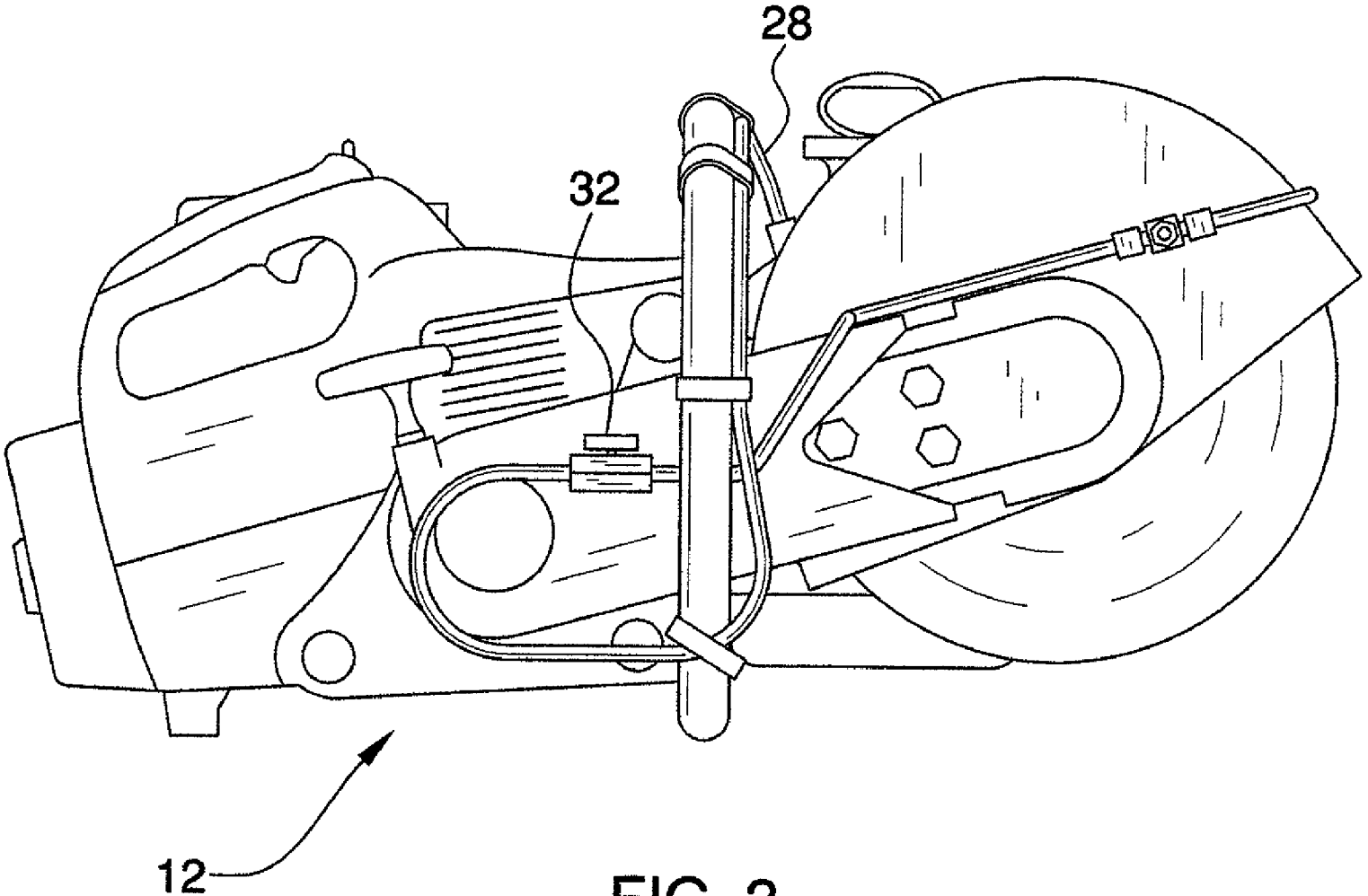
FIG. 3 is a left side view of the present invention.
Figure 4:
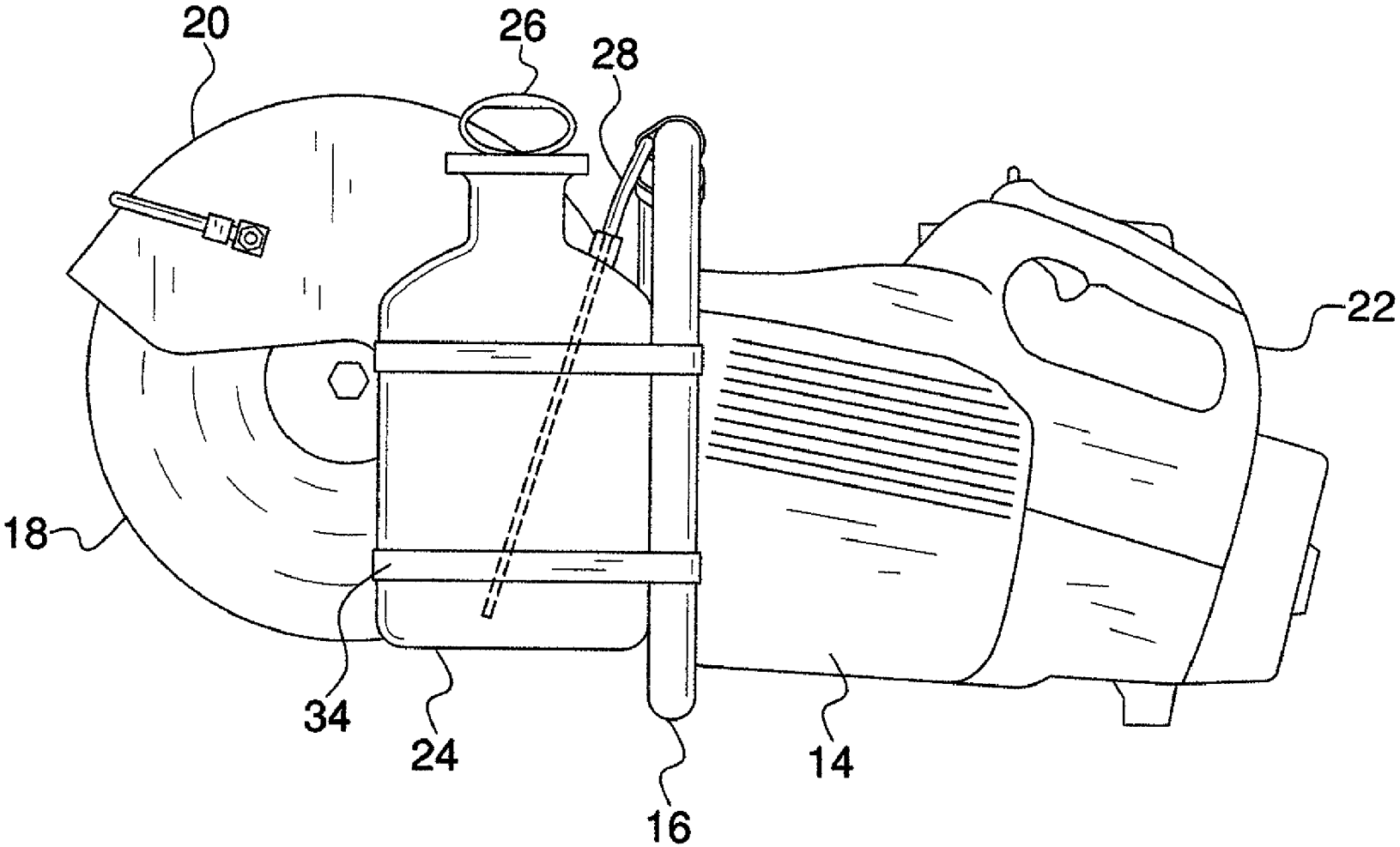
FIG. 4 is a right side view of the present invention.
Figure 5:
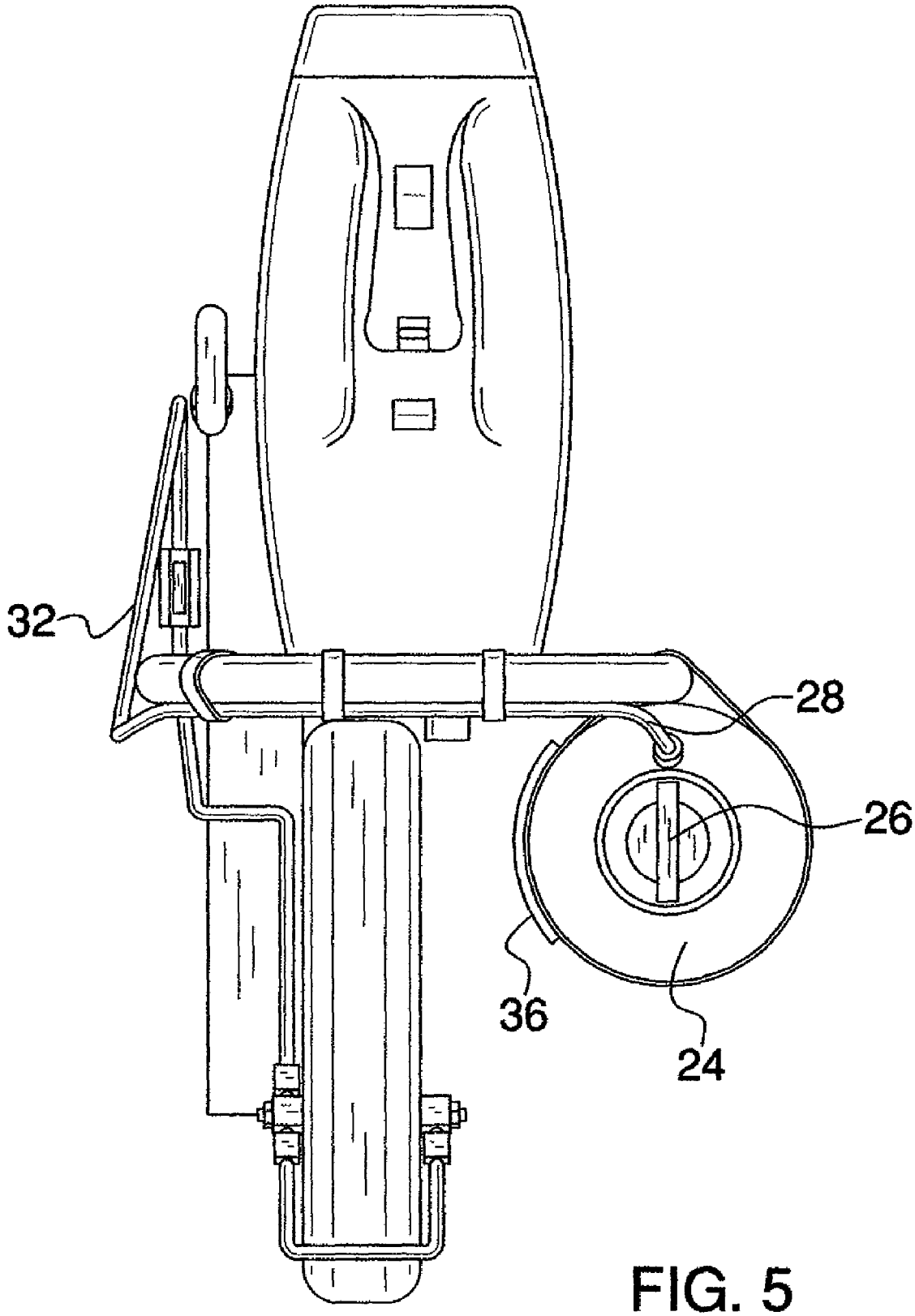
FIG. 5 is a top view of the present invention.
Figure 6:
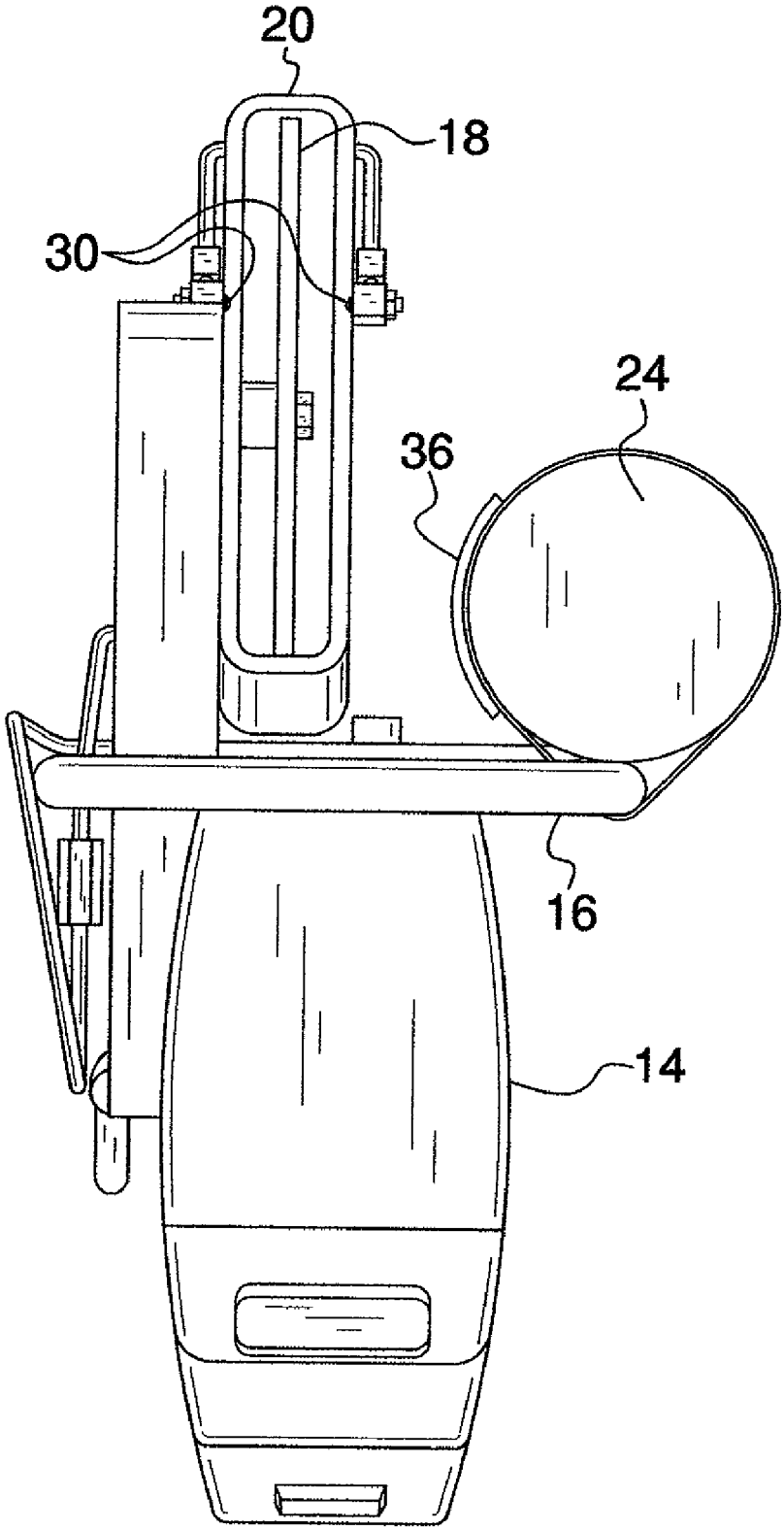
FIG. 6 is a bottom view of the present invention.
Figure 7:
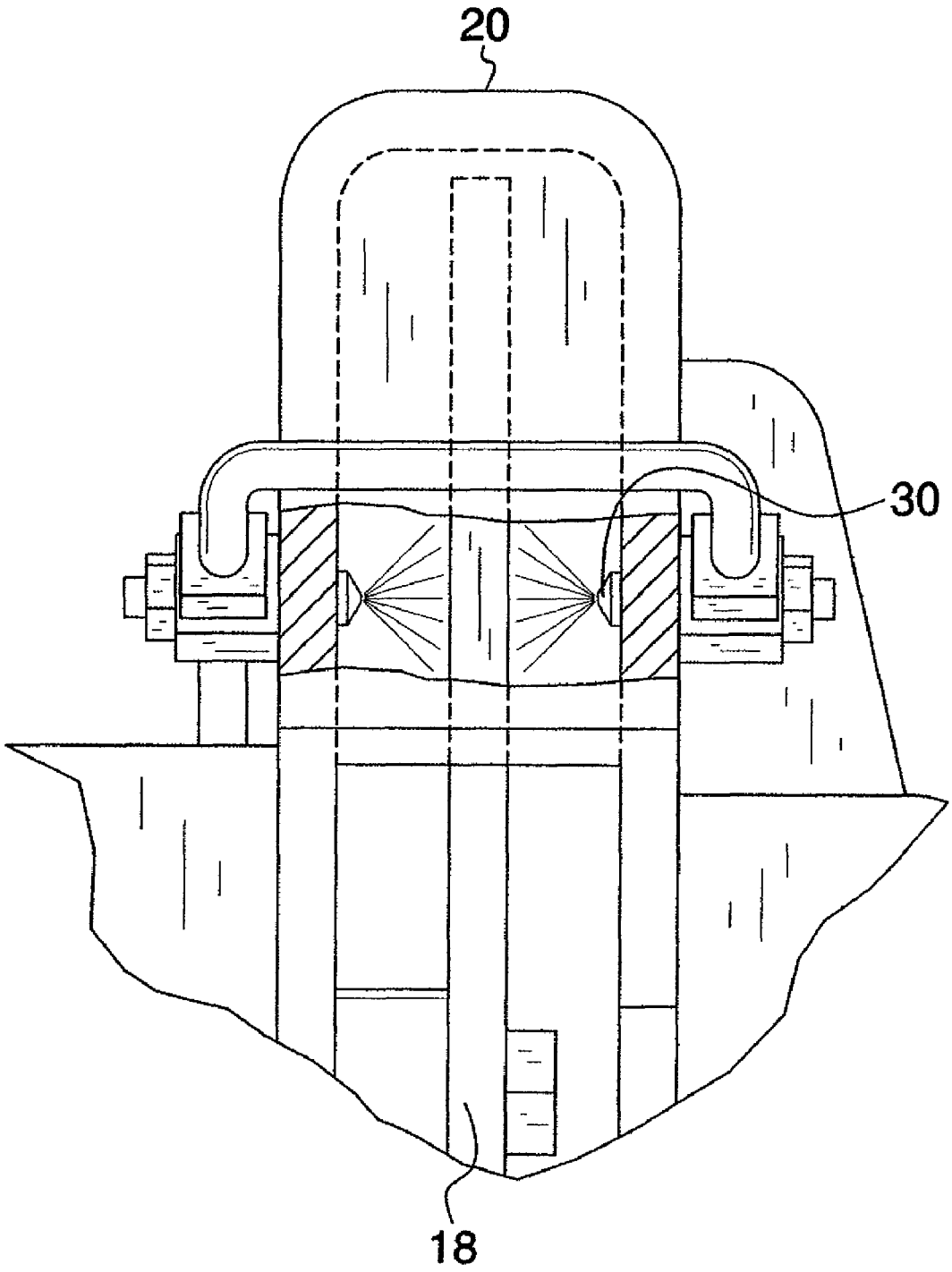
FIG. 7 is a front enlarged broken view of the present invention.

With reference now to the drawings, and in particular to FIGS. 1 through 7 thereof, a new dust reducing device embodying the principles and concepts of the present invention and generally designated by the reference numeral 10 will be described.

As best illustrated in FIGS. 1 through 7, the saw and water dispensing combination system 10 generally comprises a conventional handsaw 12 used for cutting concrete and masonry and includes a motor 14, a handle 16 attached to the motor 14, and a blade 18 that is mechanically coupled to the motor 14 and which is rotated when the motor 14 is turned on and the blade 18 engaged with the motor 14. The blade 18 is configured to cut through cement blocks. A protective shroud 20 extends over an upper portion of the blade 18 relative to the motor 14. A grip 22 is attached to the motor 14 and is located distal to the blade 18. The handsaw 12 may be gas or electric powered.

A container 24 is provided that has water therein. The container 24 is preferably constructed of a lightweight and durable material such as a plastic material. A conventional hand pump 26 is fluidly coupled to the container 24. The pump 26 creates pressure within the container 24 when the pump 26 is actuated.

An outlet conduit 28 is fluidly coupled to the container 24. Water from the container 24 is forced into the outlet conduit 28 when the pump 26 is actuated. The outlet conduit 28 ejects water onto the saw blade 18 when the water is forced out of the outlet conduit 28. The outlet conduit 28 includes a pair of nozzles 30. Each of the nozzles 30 is mounted within the shroud 20 on opposite sides of the saw blade 18 and each is directed toward the saw blade 18. A valve 32 is fluidly coupled to the outlet conduit 28 to control flow of water through the outlet conduit 28. The valve 32 allows the user to control flow rate of the water as well allow a large amount of pressure to build up within the container 24 for use at a later time.

A coupler 34 releasably couples the container 24 to the handsaw 12. The container 24 is attached to the handle 16 by the coupler 34 and comprises at least one strap extending around the container 24 and the handle. As can be seen in the Figures, it may be preferred to use a pair of straps for more stability of the container 34 relative to the handsaw 12.

A heat shield 36 is positioned between the container 24 and the handsaw 12. The heat shield 36 is mounted on the container 24 and this may be accomplished with the coupler 34. The heat shield 36 is preferably comprised of a fire retardant insulating material to prevent the container 24 from melting due to the heat from the motor 14.

In use, the handsaw 12 is used in a conventional manner to cut masonry and the like. To prevent dust from being generated during the cutting process, the water valve 32 is opened and the pump 26 actuated to cause water to be sprayed onto the saw blade 18. The water will then coat the saw blade 18 and the area being cut to prevent dust from being dispersed by the handsaw 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A saw and water dispensing combination system comprising:

a handsaw including a motor, a handle being attached to said motor, a blade being mechanically coupled to said motor and being rotated when said motor is turned on, said blade being configured to cut through cement blocks, a shroud extending over an upper portion of said blade relative to said motor, a grip being attached to said motor and being located distal to said blade;

a container having water therein, said container being attached to said handle by a coupler;

a pump being fluidly coupled to said container, said pump creating pressure within said container when said pump is actuated; and an outlet conduit being fluidly coupled to said container, water being forced into said outlet conduit when said pump is actuated, said outlet conduit ejecting water onto said saw blade.

2. The system according to claim 1, wherein said outlet conduit includes a pair of nozzles, each of said nozzles being mounted within said shroud on opposite sides of said saw blade and being directed toward said saw blade.

3. The system according to claim 1, wherein said coupler comprises at least one strap extending around said container and said handle.

4. The system according to claim 1, further including a heat shield being positioned between said container and said handsaw.

5. The system according to claim 4, wherein said heat shield is mounted on said container.

6. The system according to claim 1, further including a valve being fluidly coupled to said outlet conduit to control flow of water through said outlet conduit.

7. The system according to claim 2, further including a valve being fluidly coupled to said outlet conduit to control flow of water through said outlet conduit.

8. A saw and water dispensing combination system comprising:

a handsaw including a motor, a handle being attached to said motor, a blade being mechanically coupled to said motor and being rotated when said motor is turned on, said blade being configured to cut through cement blocks, a shroud extending over an upper portion of said blade relative to said motor, a grip being attached to said motor and being located distal to said blade;

a container having water therein;

a pump being fluidly coupled to said container, said pump creating pressure within said container when said pump is actuated;

an outlet conduit being fluidly coupled to said container, water being forced into said outlet conduit when said pump is actuated, said outlet conduit ejecting water onto said saw blade, said outlet conduit including a pair of nozzles, each of said nozzles being mounted within said shroud on opposite sides of said saw blade and being directed toward said saw blade;

a coupler releasably coupling said container to said handsaw, said container being attached to said handle by said coupler, said coupler comprising at least one strap extending around said container and said handle;

a heat shield being positioned between said container and said handsaw, said heat shield being mounted on said container; and a valve being fluidly coupled to said outlet conduit to control flow of water through said outlet conduit.

* * * * *